US006248444B1

(12) United States Patent
Kido et al.

(10) Patent No.: US 6,248,444 B1
(45) Date of Patent: Jun. 19, 2001

(54) WATER-RETENTIVE CELLULOSE FIBER, METHOD OF MANUFACTURING THE SAME, AND WATER-RETENTIVE SHEET COMPRISING CELLULOSE FIBER OF HIGH WATER RETENTIVITY

(75) Inventors: Tsutomu Kido; Noriyuki Kimura, both of Ehime; Ichiro Takeuchi; Kazuya Umino, both of Tokushima, all of (JP)

(73) Assignee: Uni-Charm Corporation, Ehime (JP)

( * ) Notice: Subject to any disclaimer, the term of this patent is extended or adjusted under 35 U.S.C. 154(b) by 0 days.

(21) Appl. No.: 09/387,172

(22) Filed: Aug. 31, 1999

Related U.S. Application Data

(62) Division of application No. 09/066,297, filed as application No. PCT/JP96/03171 on Oct. 30, 1996, now Pat. No. 5,998,025.

(30) Foreign Application Priority Data

Oct. 30, 1995 (JP) ..... 7-305124

(51) Int. Cl.[7] ..... D01F 8/00; D01F 8/02

(52) U.S. Cl. ..... 428/370; 428/373; 428/393

(58) Field of Search ..... 428/393, 370, 428/373, 374; 604/368, 372, 367

(56) References Cited

U.S. PATENT DOCUMENTS 3,844,287 * 10/1974 Smith ..... 128/263
4,610,678 * 9/1986 Weisman et al. ..... 604/368
5,538,783 * 7/1996 Hansen et al. ..... 428/283
5,998,025 * 12/1999 Kido et al. ..... 428/370

* cited by examiner

*Primary Examiner*—Newton Edwards
(74) *Attorney, Agent, or Firm*—Koda & Androlia

(57) ABSTRACT

A powdered super absorbent polymer (SAP) has heretofore been used as a water retentive material for sanitary products, such as sanitary napkin, disposable diaper and incontinence pad. This water retentive material is used by being held between two paper sheets but the powdered SAP comes off easily from absorbent member. Moreover, even when the SAP is in a dried powdered state or in a water-absorbed gel state, it is moved between a top sheet and a back sheet in accordance with the movement of a wearer of the sanitary product. Consequently, water absorbency decreases with poor shape stability. Moreover, since the SAP in a water-absorbed gel state is sticky, the wearer feels unpleasant.

According to the present invention, therefore, a cellulose fiber, such as a viscose rayon fiber containing uniformly a non-cellulose based material of high water absorbency such as polyacrylate salt is manufactured. A fiber web and non-woven fabric produced of this fiber is used as water retentive materials in an absorbent member. This fiber has high absorbency and moreover high water retentivity such that water absorbed into the fiber is hardly released from the fiber. Accordingly, an absorbent member formed of a sheet made of this fiber has a stable shape both when it is in a dry state and when it is in a water-absorbed state, and, moreover, it has high absorbency and high water retentivity. Therefore, when this water-retentive sheet is used, a thin absorbent member of high absorbency can be provided.

6 Claims, 3 Drawing Sheets

WATER-RETENTIVE CELLULOSE FIBER, METHOD OF MANUFACTURING THE SAME, AND WATER-RETENTIVE SHEET COMPRISING CELLULOSE FIBER OF HIGH WATER RETENTIVITY

This is a Divisional Application of Application Ser. No. 09/066,297, filed Apr. 27, 1998, now U.S. Pat. No. 5,998,025, which is a Nat'l stage App. of PCT/JP96/03171 filed Oct. 30, 1996.

TECHNICAL FIELD

The present invention relates to a cellulose based fiber of high water retentivity for use as a water-retentive material in an absorbent member absorbing body fluids in sanitary napkin, disposable diaper, incontinence pad and the like, and a method of manufacturing the same and a water-retentive sheet prepared from the fiber.

BACKGROUND ART

Absorbent members are arranged at areas receiving body fluids such as urine and blood of menstruation, in sanitary goods such as disposable diaper and sanitary napkin. The absorbent members have a structure such that pulp or a super absorbent polymer (referred to as "water-retentive material" hereinafter) is interposed between a liquid pervious sheet such as nonwoven fabric and a liquid impervious sheet such as polyolefin. In recent years, it has been demanded to prepare these sanitary goods as compact type and slim type. Thus, it is required to improve performance and shape stability of the water-retentive material in the absorbent members.

Absorbent materials of powdered polymer and absorbent materials of fibrous polymer have been known conventionally as a water-retentive material, and as described in "Journal of Industrial Materials", Vol.42, No.4, p.18, generally, absorbent materials of powdered polymer are used.

As the absorbent members of powdered polymer, it has been known synthetic polymers such as polyacrylate based compounds and polyvinyl based compounds as well as natural polymers such as cyanomethyl cellulose and carboxymethyl cellulose.

As the absorbent members of fibrous polymer, the following fibers have been known; a fiber produced by a process of mixing sodium salt of carboxymethyl cellulose with viscose prior to spinning, as described in Japanese Patent Laid-open (kokai) No. 56-9418; a fiber produced by a process of carboxymethylating regenerated cellulose fiber, as described in Japanese Patent Publication (kokoku) No.60-2707; and a fiber of a bilayer structure, produced by hydrolyzing an acrylonitrile fiber, thereby forming a polyacrylate based absorbent layer on the outer surface, as described in Japanese Patent Laid-open (kokai) No.55-132754.

For using such water-retentive materials in absorbent members of sanitary goods such as disposable diaper and sanitary napkin, the materials are required to have high absorbency. Furthermore, it is also required that the water-retentive materials have a property such that water once absorbed into the materials should not be released from the materials even under pressure, namely so-called high water retentivity.

For using the fibrous water-retentive materials as the water-retentive materials in absorbent members, the fibrous water-retentive materials are required to have a fiber strength of about 0.8 g/denier (g/d) at their dry state, from the respect of handling of the fibrous water-retentive materials at manufacturing stages.

However, such powdered water-retentive materials come off easily from the absorbent members. The water-retentive materials turn into a gel state with high fluidity in a water-absorbed state, disadvantageously, so such materials are poor in terms of shape stability.

For using the powdered water-retentive materials as a water-retentive material in absorbent members of disposable diaper and the like, the water-retentive materials turn into a gel state within the disposable diaper, when the water-retentive materials absorb urine. Following the motion of a wearer with such disposable diaper thereon, the gel makes a sift with the resultant uneven distribution of the gel in the absorbent member. Additionally, the gel is sticky. Therefore, the wearer feels unpleasant touch and poor feeling during use.

Because the viscose and carboxymethyl cellulose in the fibrous water-retentive material produced by mixing the sodium salt of carboxymethyl cellulose with viscose are both cellulose base, these are highly compatible with each other. Therefore, the water-retentive material has good characteristics as fiber. However, the water retentivity is not sufficient.

In the fibrous water-retentive material produced by carboxymethylating rayon, because the fiber has water absorbency as a whole, the fiber of itself turns into a gel state when the material absorbs water. Accordingly the material are poor in terms of shape stability. Disadvantageously, the fiber strength is low in a dry state.

The fibrous water-retentive material of such bilayer structure, produced by forming a polyacrylate based absorbent layer on the outer surface of an acrylonitrile based fiber, is disadvantageous in that the process of producing the water-retentive material is complex.

In accordance with the present invention, the aforementioned problems are to be solved. The present invention provide a fiber of high water retentivity which is safe for use as absorbent members of sanitary goods such as disposable diaper and sanitary napkin, which also has a high water retentivity, greater shape stability because the fiber can retain the fiber shape even in a water-absorbed state, and a fiber strength sufficient enough for handling at its dried state, as well as an absorbent member wherein the fiber of high water retentivity is used.

DISCLOSURE OF THE INVENTION

The present invention relates to a cellulose based fiber of high water retentivity comprising a cellulose fiber which contains uniformly a non-cellulose based material of high absorbency.

In the cellulose based fiber of high water retentivity of the present invention, a cellulose fiber and an material of high absorbency are sufficiently mixed together to an extent such that the fiber and the material which can absorb water cannot be discriminated from each other, so that the material of high absorbency is uniformly dispersed in the cellulose fiber. Both the cellulose fiber and the material of high absorbency have high water absorbency and high water retentivity. Accordingly, the cellulose based fiber of high water retentivity uniformly containing the two components is more excellent in terms of absorbency and water retentivity than conventional fibers singly composed of cellulose or the super absorbent polymers (SAP). Even at mechanic processing stages such as yarn splitting stage or at a water-absorbed state, the material of high absorbency hardly comes off from cellulose based fiber of high water retentivity. When the fiber absorbs water, the material of high absorbency exposed to the outer surface of the cellulose based fiber of high water retentivity may eventually come off. The other hand, there is an advantage such that water can be efficiently absorbed by the material of high absorbency on the outer surface.

Additionally, the cellulose based fiber of high water retentivity of the present invention includes a complex fiber wherein a component of cellulose fiber which contains uniformly a non-cellulose based material of high absorbency and a single component of cellulose are attached to each other in a side by side type.

Furthermore, the fiber of the present invention includes a complex fiber wherein a core is formed from a component of cellulose fiber which contains uniformly a non-cellulose based material of high absorbency and the core is enveloped with a sheath prepared from a single component of cellulose.

In the said complex fiber of side by side type, a component containing a material of high absorbency uniformly dispersed in cellulose fiber is attached to the single component of cellulose, wherein the component containing the material of high absorbency has water absorbency and water retentivity while the single component of cellulose retains the mechanical properties as a fiber. Therefore, the resulting fiber has high water absorbency and high water retentivity, together with higher fiber strength and greater shape stability.

The said complex fiber of sheath-core type wherein the core prepared from the component of the material of high absorbency uniformly dispersed in cellulose fiber is attached to the sheath prepared from the single component of cellulose, has a structure such that the component containing the material of high absorbency (core) is covered with the single component of cellulose (sheath). Even at a water-absorbed state or even at any stage of the fiber production, therefore, the material of high absorbency does not come off from the fiber. By preparing the sheath component as a thin coating film, then, water absorbency can be retained.

The complex fibers of the side by side type and the sheath-core type have higher absorbency and water retentivity and also have higher dry strength of the fiber produced by uniformly dispersing the material of high absorbency in the cellulose fiber than the fiber prepared from the single component, even when the content of the material of high absorbency in the cellulose fiber in the complex fiber is equal to the content of the material of high absorbency in the cellulose fiber in the fiber composed of a single component.

In accordance with the present invention, the cellulose fiber primarily means viscose-rayon fiber. However, other hydrophilic cellulose fibers may be used satisfactorily.

In accordance with the present invention, furthermore, the material of high absorbency primarily means polyacrylate salt. The polyacrylate salt is commercially available, generally and readily, as polyacrylate based absorbents or polyacrylate based super absorbent polymers. (Journal of Industrial Materials, Vol.42, No.4, p.26.) The polyacrylate based absorbents or polyacrylate based super absorbent polymers are absorbent polymers primarily comprising slightly cross-linked polyacrylate salt, polyacrylate salt grafted onto starch or polyacrylate backbone, and these may be used singly or in combination with two or more thereof. Furthermore, an isobutylene-maleic anhydride copolymer may be used. As the material of high absorbency, additionally, use may satisfactorily be made of super absorbent polymers based on polyvinyl alcohol or polyoxyethylene.

The absorbency of the cellulose based fiber of high water retentivity of the present invention is 700% or more. The term "absorbency" herein means a value represented by the following formula 1;

$$V(\%)=\{(B-A)/A\}\times 100 \qquad \text{Formula 1)}$$

wherein A is the weight in gram of the fiber prior to water absorption; and B is the weight in gram of the fiber after water absorption and draining.

The water retentivity of the cellulose based fiber of high water-retentive is 200% or more Th e term "water retentivity" herein means a value represented by the following formula 2;

$$W(\%)=\{(D-C)/C\}\times 100 \qquad \text{(Formula 2)}$$

wherein C is the weight in gram of the fiber prior to water absorption; and D is the weight in gram of the fiber after water absorption and draining and subsequent centrifuge for dehydration.

As described above, the cellulose based fiber of high water retentivity has higher water absorbency and water retentivity. In both a dry state and a water-absorbed state, the cellulose based fiber of high water retentivity can retain the fiber shape. When the fiber is enveloped in a paper sheet to form an absorbent member for use in disposable diaper and sanitary napkin, the fiber does not make any shift in the disposable diaper and the sanitary napkin. Thus, disposable diapers and sanitary napkins with high water absorbency and water retentivity can be provided while a wearer will not feel any unpleasant touch therewith.

Alternatively the cellulose based fiber of high water retentivity can be prepared as sheet form or can be knitted into other fiber webs or nonwoven fabric. Then, an absorbent member may satisfactorily be prepared from those. The resulting absorbent member thus formed has higher water absorbency and water retentivity even if it is so slim in its thickness. Therefore, when the absorbent member is used in disposable diaper and sanitary napkin, the resulting disposable diaper and sanitary napkin can be prepared as slim type.

Furthermore because the polymer forming fiber in the cellulose based fiber of high water retentivity of the present invention is not a synthetic polymer substance such as polyacrylonitrile but cellulose, it has such properties to be readily degradable and is further rapidly degradable in soil.

At a process of manufacturing the cellulose based fiber of high water retentivity into a sheet form or at a process of mixing the fiber into other fiber webs or nonwoven fabric, preferably, the dry strength of the fiber is 0.8 g/denier (g/d) or more and the fineness thereof is 5 denier or more to 15 denier or less, for easy handling of the fiber. The unit of dry strength, namely "g/d", means the tensile strength of a fiber corresponding to one denier. When the fineness is above 15 denier, furthermore, the water absorbency is reduced. Therefore, the fineness is preferably 15 denier or less.

Additionally, more preferably, other super absorbent polymers and pulp may be mixed with the fiber. A plurality of the sheets, nonwoven fabric or fiber web, containing the cellulose based fiber of high water retentivity of the present invention, are laminated together or held between paper sheets from both the upper face and lower face, followed by adhesion. After adhesion, then, the resulting sheet is molded into a given shape to form an absorbent member. Otherwise, the sheets, nonwoven fabric or fiber web, containing the cellulose based fiber of high water retentivity of the present invention, may be molded into a given shape, prior to adhesion. Or the cellulose based fiber of high water retentivity is mixed with a hot-melt type fiber, followed by thermal processing to prepare a sheet of a given shape. Because the cellulose based fiber of high water retentivity in this sheet is securely bonded to each other through the hot-melt type fiber, the shape is hardly broken. At the process of bonding the sheets, furthermore, the sheets can be thermally bonded to each other. At this thermally-bonding process, the sheets can be uniformly bonded as a whole. Preferably, the water-retentive sheet contains the cellulose based fiber of high water retentivity at 10% by weight or more to 80% by weight or less, while the sheet contains the hot-melt type fiber at 20% by weight or more to 80% or less.

The basis weight of the sheet containing the fiber of high water retentivity is preferably 10 $g/m^2$ or more to 500 $g/m^2$ or less.

The method of manufacturing the cellulose based fiber of high water retentivity in accordance with the present invention comprises spinning, elongation and refining a stock solution for spinning as a raw material which is a homogeneous mixture of a non-cellulose based material of high absorbency with cellulose fiber.

So as to produce a complex fiber of side by side type or sheath-core type, the stock solution of a homogenous mixture of a non-cellulose based material of high water absorbency with the cellulose based component is mixed with a stock solution component singly composed of cellulose fiber by means of a nozzle, which is then spun, elongated and refined.

For using viscose-rayon fiber as the cellulose fiber and polyacrylate salt as the non-cellulose based material of high absorbency in the fiber of high water retentivity of the present invention, routine viscose for viscose-rayon fiber is used for the stock solution. Term "routine viscose for viscose-rayon fiber" primarily means viscose for general viscose rayon, at a cellulose concentration of 7% by weight or more to 10% by weight or less and an alkali concentration of 5% by weight or more to 6% by weight or less and with a Hottenroth number of 8 to 12. As the alkali in this viscose, primarily, use is made of sodium hydroxide. Otherwise, any viscose with a modified composition of the individual components in the viscose may satisfactorily be used. Otherwise, viscose for strong rayon, viscose for polynosic, or viscose for HWM may also be used.

For using polyacrylate salt as the non-cellulose based material of high absorbency, the polyacrylate salt is satisfactorily mixed with the stock solution of viscose. Then, the amount of the polyacrylate salt to be mixed should be at 10% by weight or more to 200% by weight or less to the total weight of the cellulose fiber in the viscose. If the amount thereof to be mixed is less than 10% by weight, the water retentivity is not sufficient enough. If the amount thereof is above 200% by weight, alternatively, the polyacrylate salt is present excessively in the stock solution of viscose, which causes poor stringiness in a regeneration bath during spinning, disadvantageously for smooth spinning.

At the process of manufacturing the cellulose based fiber of high water retentivity, treatment with an alkaline solution is preferably carried out after refining. The alkaline solution to be used for the alkali treatment is preferably an aqueous sodium carbonate solution or an aqueous sodium bicarbonate solution. Through such alkali treatment, the absorbency and water retentivity of the fiber can be enhanced.

BEST MODE FOR CARRYING OUT THE INVENTION

A method of manufacturing a viscose rayon-polyacrylate based fiber of high water retentivity will now be described herein as one example of the cellulose based fiber of high water retentivity of the present invention, wherein rayon is used as the cellulose fiber, and polyacrylate salt is used as the material of high absorbency. In the fiber of high water retentivity of the present invention, use may be made of other hydrophilic cellulose fibers as the cellulose fiber, other than the rayon. As the material of high absorbency, additionally, use may be made of material of high absorbency of synthetic polymers based of polyvinyl alcohols and polyoxyethylenes, other than polyacrylate salt.

Figure 1:
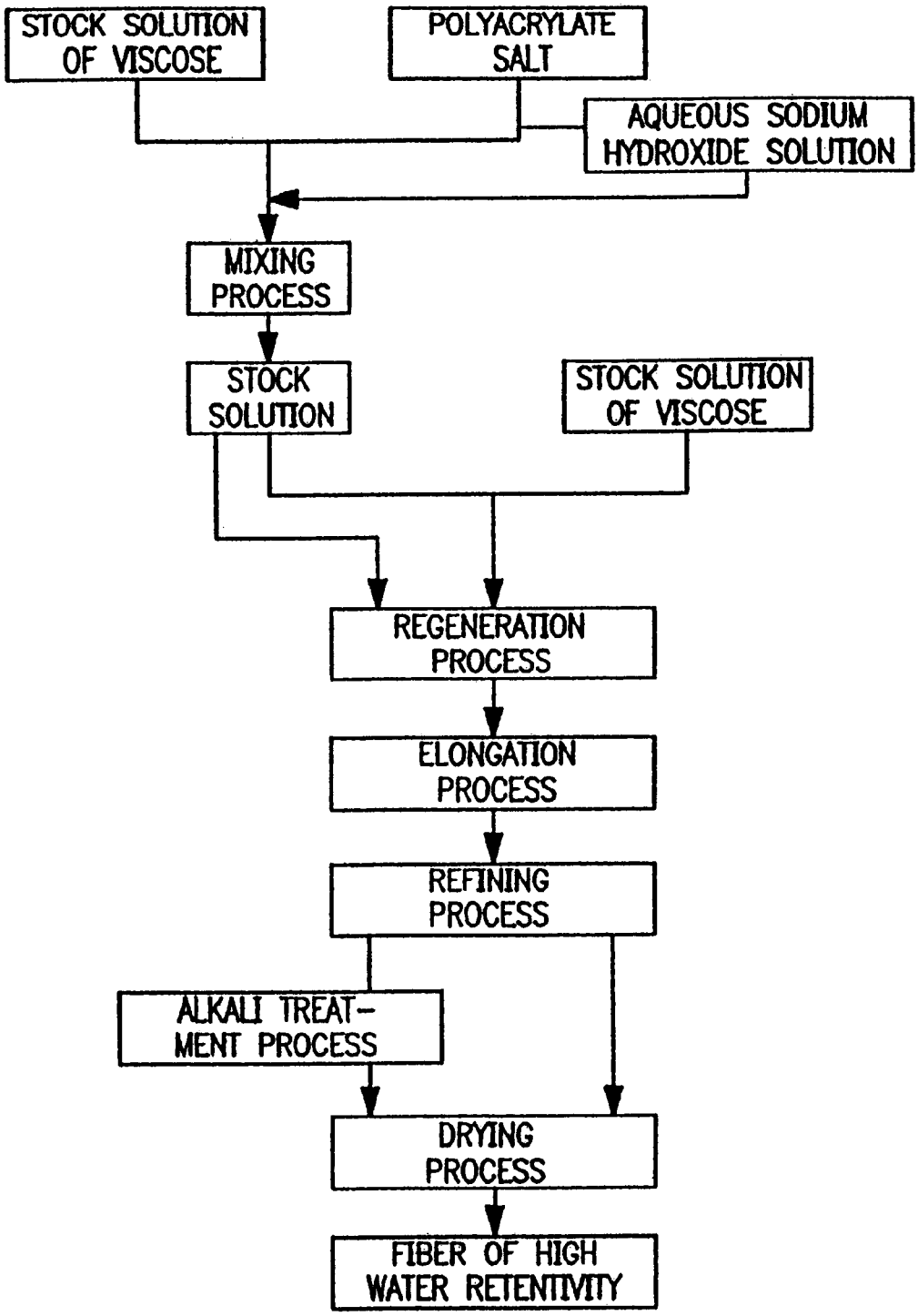
FIG. 1 is a view depicting the flow sheet of the manufacturing process of the fiber of high water retentivity of the present invention. Furthermore.

FIG. 1 depicts the flow sheet of the manufacturing process of the fiber of high water retentivity of the present invention, wherein the symbol 1 represents stock solution of viscose;

2 represents polyacrylate salt;

3 represents aqueous sodium hydroxide solution;

4 represents a process of mixing the stock solution of viscose 1 with the polyacrylate salt 2 wherein A represents the stock solution from the mixing process described above and B represents a stock solution of viscose containing only cellulose fiber;

5 represents a regeneration process comprising discharging the stock solution A or the stock solution A and the stock solution of viscose B from a nozzle into a regeneration bath and solidifying the stock solution A or the stock solution A and the stock solution of viscose B;

6 represents an elongation process of the yarn produced at the regeneration process 5;

7 represents a refining process of refining the elongated yarn by bleaching and the like;

8 represents an alkali treatment process of treating the refined yarn in an alkali;

and 9 represents a drying process of drying the fiber produced at the refining process 7 or the alkali treatment process 8. Additionally, F represents viscose rayon-polyacrylate based fiber of high water retentivity produced through the manufacturing process shown in FIG. 1.

For spinning the single component of the viscose rayon-polyacrylate based fiber, the stock solution of viscose B is not used.

As the stock solution of viscose for use in producing the fiber of high water retentivity of the present invention as shown by the symbol 1, use is made of for example a stock solution of routine viscose rayon fiber. The stock solution for routine viscose rayon fiber is a viscose for general viscose rayon, principally with a cellulose concentration of 7% by weight or more to 10% by weight or less, a sodium hydroxide concentration of 5% by weight or more to 6% by weight or less and a Hottenroth number of 8 to 12. Otherwise, any viscose with a modified composition of these individual components may satisfactorily be used. Additionally, viscose for strong rayon, viscose for polynosic, and viscose for HWM may also be used. As the alkali component in viscose, generally, use is made of sodium hydroxide as described above. Other alkali components may satisfactorily be used.

The polyacrylate salt 2 is in powder at a dry state. In accordance with the present invention, preferably, use is made of the powder with a particle size of 30 micron or less. If the particle size is above 30 micron, the stringiness is deteriorated during spinning; additionally, the polyacrylate salt is exposed to a fiber surface of a produced water-retentive fiber F, so that the polyacrylate salt comes off easily from the fiber F. The particle size of the polyacrylate salt is preferably 10 micron or less, more preferably 5 micron or less.

At the mixing process 4 of mixing the stock solution of viscose 1 with the polyacrylate salt 2, the dispersibility of the polyacrylate salt 2 is deteriorated, when the polyacrylate salt 2 in powder is directly added into the stock solution of viscose 1, so that these cannot be mixed together uniformly. Therefore, the polyacrylate salt 2 is preliminarily dispersed in aqueous sodium hydroxide solution 3, and the resulting solution is added to the stock solution of viscose 1 for mixing under agitation. Because sodium hydroxide is contained as an alkali component in the stock solution of viscose 1, the mixture solution of the polyacrylate salt 2 and the aqueous sodium hydroxide solution 3 is readily dispersed in the stock solution of viscose 1. Hence, the polyacrylate salt 2 can be dispersed uniformly in the stock solution of viscose 1. The alkali solution in which the polyacrylate salt 2 is dissolved may be any alkali solution as long as the solution contains the same alkali component as the alkali component in the stock solution of viscose. When another alkali other than sodium hydroxide is used as the alkali component in the stock solution of viscose 1, an aqueous solution containing this alkali is used instead of the aqueous sodium hydroxide solution 3.

The concentration of the aqueous sodium hydroxide solution 3 is 10% by weight or more to 30% by weight or less. Satisfactorily, the concentration of sodium hydroxide in the aqueous sodium hydroxide solution 3 is adjusted to be almost equal to the sodium hydroxide concentration in the stock solution of viscose 1. Then, the polyacrylate salt 2 is then added into the aqueous sodium hydroxide solution 3 to a final polyacrylate salt 2 concentration in the aqueous sodium hydroxide solution 3 of 20% by weight or more to 40% by weight or less. In the viscose rayon-polyacrylate based fiber F of high water retentivity, the polyacrylate salt 2 is blended to a final extent of 10% by weight or more to 200% by weight or less to the total weight of the cellulose contained in the viscose rayon-polyacrylate based fiber F of high water retentivity. If the polyacrylate salt is blended above 200% by weight, the stringiness is deteriorated, to cause difficulty in producing any fiber; if the polyacrylate salt is below 10% by weight, however, the resulting fiber F of high water retentivity cannot get sufficient water retentivity.

At the subsequent mixing process 4, furthermore, the aqueous sodium hydroxide solution 3 is added to a mixture solution of the stock solution of viscose 1 and the polyacrylate salt 2, to adjust the cellulose concentration, the sodium hydroxide concentration and the weight ratio of the polyacrylate salt to cellulose, whereby stock solution A is prepared.

For manufacturing a fiber from the single component of polyacrylate salt uniformly contained in cellulose fiber, the following spinning process is conducted for spinning, by using only one raw material of the stock solution A. For manufacturing a complex fiber by compounding a component composed of a polyacrylate salt uniformly contained in cellulose fiber and a component singly composed of cellulose fiber, the following spinning process is conducted for spinning, by using the spinning stock solution A and the stock solution of viscose B never containing polyacrylate salt, as the raw materials. The stock solution of viscose B is viscose for general viscose rayon. This spinning process is the same as for spinning viscose rayon.

At the regeneration process 5, firstly, the stock solution A or the stock solution A and the stock solution of viscose B are discharged into a regeneration bath.

For manufacturing a complex fiber from the raw materials of the stock solution A and the stock solution of viscose B, use is made of nozzles having a shape for general use for spinning general acrylonitrile based complex fibers, and at the nozzle opening of such nozzle, the stock solution A is prepared as a complex with the stock solution of viscose B.

Figure 2:
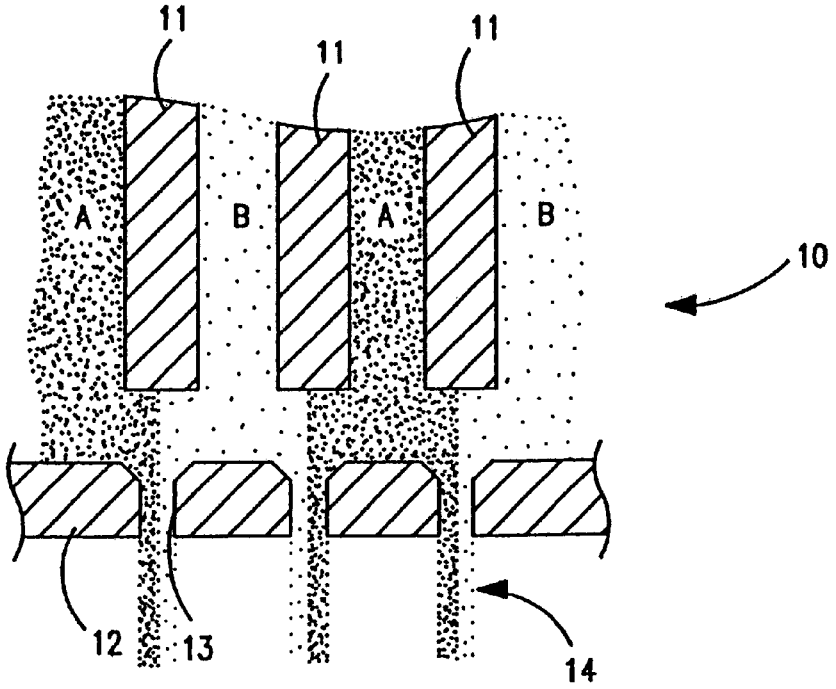
FIG. 2 is a model view depicting the cross sectional structure of the complex part of a typical spinning nozzle for a complex fiber. The nozzle is used at the manufacturing process of the fiber of high water retentivity of the present invention. Still furthermore.

FIG. 2 is a model view of the cross sectional structure of the typical spinning nozzle for use for complex fiber.

In FIG. 2, 10 represents the nozzle in its entirety; 11 represents a partition wall; 12 represents a nozzle board; 13 represents a nozzle opening; and 14 represents yarn discharged from the nozzle opening 13. In the area inside the nozzle, the stock solution A and the stock solution of viscose B to be blended together as a complex are independently placed and fed, while the partition wall 11 works to separate them. For manufacturing a fiber from the stock solution A alone, the stock solution A is fed into both the sides of the partition wall 11 or a nozzle with no partition wall 11 is used.

The stock solution A and the stock solution of viscose B are associated and compounded to each other at the nozzle opening 13. Depending on the difference in feed amount between the two components, namely the stock solution A and the stock solution of viscose B, the compound ratio of the two components varies. The volume ratio of the two components can freely be preset. In this case, given amounts of the stock solution A and the stock solution of viscose B are fed so that the ratio of the cellulose in the fiber produced from raw material of the stock solution A to the cellulose in the fiber produced from raw material of the stock solution of viscose B might be for example 1:1 or 1:2.

The complex fiber produced from the stock solution A and the stock solution of viscose B includes a complex fiber of side by side type, as produced by simply attaching the fiber produced from the stock solution A with the fiber produced from the stock solution of viscose B, and a complex fiber of sheath-core type, wherein the sheath comprising the stock solution of viscose B envelops the core comprising the fiber from the stock solution A. By appropriately modifying the viscose concentration in the stock solution of viscose B and the feed amount of the stock solution of viscose B, a complex fiber of any one of these types, i.e., a complex fiber of side by side type or sheath-core type, may satisfactorily be formed by using the same nozzle. In accordance with the present invention, particularly a complex fiber of sheath-core type is produced by discharging the stock solution of viscose B and stock solution A from the nozzle, while diluting the stock solution of viscose B as the sheath raw material to a final viscose concentration of 30% by weight to 60% by weight by using an aqueous sodium hydroxide solution and setting the feed amount of the stock solution of viscose B at 1.5-fold or more that of the stock solution A.

Then, the sheath component is formed from the stock solution of viscose B at a low concentration of cellulose fiber, while the core component is formed from the stock solution A, to prepare a complex fiber of sheath-core type where the core component is enveloped with the sheath component.

Figure 3:
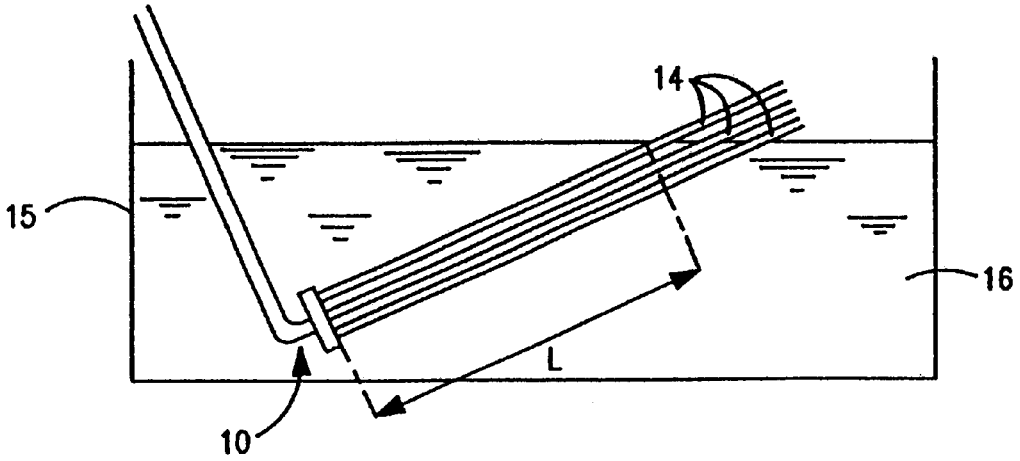
FIG. 3 is a transverse cross sectional view of the regeneration bath at the regeneration process.

As shown in FIG. 3, nozzle 10 is placed in regeneration bath 15; stock solution A, or stock solution A and stock solution of viscose B, as discharged from the nozzle 10, are charged into aqueous solution 16 in the regeneration bath 15 immediately after discharge. As the aqueous solution 16 in the regeneration bath 15, use is made of an aqueous solution for use in regeneration baths for general viscose rayon, as it is. More specifically, use is made of an aqueous solution produced by mixing together sulfuric acid, sodium sulfate and zinc sulfate in 1 liter of water at a ratio of 90 g or more to 120 g or less, 300 g or more to 400 g or less and 10 g or more to 20 g or less, respectively, at a temperature of 40° C. or more to 50° C. or less. The stock solution A, or the stock solution A and stock solution of viscose B, are discharged from the nozzle 10 and are then solidified through the reaction with the sulfuric acid in the aqueous solution 16, to prepare yarn 14 in a gel state. In FIG. 3, the yarn 14 discharged from the nozzle 10 is immersed at the length shown by L, in the aqueous solution in the regeneration bath. The length L is called as spinning bath immersion length. In accordance with the present invention, the spinning bath immersion length is preferably 20 cm or more to 60 cm or less.

The stock solution A, or the stock solution A and the stock solution of viscose B are discharged at a discharge linear velocity of 5 m/min or more to 20 m/min or less into the regeneration bath 15. Then, yarn 14 in a gel state is formed in the regeneration bath 15. The yarn 14 in the gel state is given 50% to 300% (1.5-fold to 4.0-fold) draft, which is drawn out from the regeneration bath 15 by means of a roller.

The yarn 14 in the gel state, which is drawn out from the regeneration bath 15, is wound and elongated over a roller at elongation process 6. At the elongation process 6, the molecules in the yarn 14 are regularly aligned. When the molecules are aligned in two orientations, then, the tensile strength of the fiber F of high water retentivity is enhanced but is hardly elongated.

At the elongation process 6, the yarn 14 in the gel state is elongated in air, or in water bath, or in combination of the two. The yarn in the gel state is then elongated in the same manner as for general viscose rayon, so that the elongated length might be longer by 30% to 50% than the original length, namely 1.3-fold to 1.5-fold the original length.

For elongating the yarn 14 in the gel state in a water bath, the aqueous solution 16 in the regeneration bath 15 sticks on the yarn 14 in the gel state, and therefore, the aqueous solution 16 is sometimes mixed into a water bath at the elongation process, which does not cause any specific problem. For the elongation in a water bath, a single bath may be satisfactory for elongation in only one water bath or a multi-step bath may be satisfactory for elongation in multiple baths. However if the polyacrylate salt in the yarn 14 is exposed to the outer surface of the yarn 14 in the gel state or is at a state close to the said state at the elongation process 6, the polyacrylate salt is squeezed out from the yarn 14 for elongation, involving a high possibly for the polyacrylate salt to come off from the yarn 14. Thus for producing the viscose rayon-polyacrylate based fiber of high water retentivity of the present invention, the yarn 14 in the gel state is preferably elongated while it is running in the air.

In a complex fiber of side by side type, in particular, the cellulose fiber containing the polyacrylate salt as produced from the stock solution A is attached to the fiber singly composed of the cellulose as produced from the stock solution of viscose B, and therefore, the particles of the polyacrylate salt are unevenly distributed and blended in either one component at a high density. Accordingly, the polyacrylate salt readily comes off from the yarn 14 at the elongation process 6. Thus, the yarn is preferably elongated while it is running in the air.

The elongation can be more readily conducted if the temperature for elongation is higher. Therefore, when the elongation is conducted while the yarn is running in the air, the elongation is preferably conducted in heated air or heated steam.

The yarn 14 passing through the elongation process 6 is then introduced into refining process 7. The refining process 7 is the same as the refining process of manufacturing viscose rayon. More specifically, the yarn 14 is treated with an aqueous mixture solution of sodium sulfide and sodium hydroxide at a temperature of 60° C. to 70° C., to remove fine residual sulfur contained in the yarn 14. The aqueous mixture solution contains 3.0±1.0 g of sulfuric acid and 1.0 g±0.5 g of sodium hydroxide per one liter. Then, bleaching in an aqueous sodium hypochlorite solution and neutralization of the bleaching agent with sulfuric acid are performed.

The yarn passing through the refining process 7 is dried at the drying process 9. After passing through the drying process 9, the viscose rayon-polyacrylate based fiber F of high water retentivity is produced. Depending on the need, the alkali treatment 8 is conducted prior to the drying process 9. Through such alkali treatment, the absorbency and water retentivity of the fiber can be further enhanced. Because the aqueous solution 16 in the viscose rayon regeneration bath 15 is an acid solution, the absorbency of the polyacrylate salt in mixture is deteriorated, with a resulting reduction of the water retentivity. However, the water retentivity of the polyacrylate salt can be enhanced more by carrying out the alkali treatment.

The alkali to be used for the alkali treatment is any alkaline substance for general use. More specifically, the alkali includes inorganic compounds such as alkali metal hydroxides, carbonates and bicarbonates; and basic organic compounds such as ethanol amine and alkanol amine. As the alkali metal, use is made of sodium and potassium and the like. However, the alkali to be used for the alkaline treatment is preferably sodium carbonate, in particular. The reason resides in that the time and alkali concentration required for the treatment are the shortest and the lowest, respectively, with absolutely no concern over the adhesion of the fibers. For the alkaline treatment, an aqueous solution containing these alkaline substances is used. Using an aqueous sodium carbonate solution for the alkaline treatment, for example, the concentration of sodium carbonate in the aqueous solution is particularly preferably 0.5% by weight or more to 10% by weight or less, while the pH of the aqueous solution is 10 or more to 12 or less. The yarn 14 produced through the refining process 7 is immersed in the aqueous sodium carbonate solution at ambient temperature for one minute to 10 minutes. The concentration of the aqueous solution below 0.5% by weight is unsatisfactory for enhancing the absorbency; the concentration above 10% by weight triggers the adhesion of the fibers, so that water retentivity of 200% or more cannot be obtained. Similarly the treatment time below one minute causes insufficiency in the treatment; above 10 minutes, the fibers adhere to each other.

By the aforementioned processes, viscose rayon-polyacrylate based fiber F of high water retentivity is produced. In the fiber produced from the stock solution A as a raw material, the rayon fiber is thoroughly mixed with the polyarylate salt, to an extent such that the two cannot be discriminated from each other; in other words, the polyacrylate salt is uniformly dispersed in the rayon fiber. Both the rayon fiber and the polyacrylate salt have high absorbency and are greatly water retentive. Accordingly, the highly water-retentive fiber F uniformly containing the two components is more excellent, in terms of absorbency and water retentivity, than the conventional fiber singly composed of cellulose fiber or super absorbent polymers. In some of such highly water-retentive fiber F, the polyacrylate salt is exposed to the outer surface of the fiber. Therefore, the polyacrylate salt on the outer surface of the fiber F may come off. Nevertheless, the polyacrylate salt on the outer surface can effectively absorb water. Still more, both at a dry state and at a water-absorbed state, the fiber F can retain the shape as fiber.

In the fiber of side by side type wherein the component produced by uniformly dispersing polyacrylate salt in rayon fiber is attached to the single rayon component, the component containing the polyacrylate salt has absorbency and water retentivity, while the single rayon component has mechanical properties as fiber. Therefore, the resulting fiber has properties including absorbency, water retentivity, fiber strength and shape stability.

In the complex fiber of sheath-core type produced by attaching the sheath of the single rayon component on the core component produced by dispersing uniformly polyacrylate salt in rayon, the complex fiber has a structure such that the component containing the polyacrylate salt is coated with the single rayon component. Thus the polyacrylate salt never comes of from the fiber F, at water-absorbed state or at any stage of producing fiber. By preparing the sheath component as a thin coating film, the water absorbency can be procured.

The complex fibers of the side by side type and the sheath-core type can get higher absorbency and water retentivity than the fiber composed of the single component, even if the content ratio of the polyacrylate salt to the rayon fiber in the complex fiber is equal to the content ratio of the polyacrylate salt to the rayon fiber in the fiber composed of the single component of the polyacrylate salt uniformly dispersed in the rayon fiber. Furthermore, such complex fibers have higher dry strength.

The absorbency and water retentivity of the viscose rayon-polyacrylate based fiber F of high water retentivity of the present invention, thus produced, are 700% or more and 200% or more, respectively. The term "absorbency" herein means the value represented by the following formula 1;

$$V(\%)=\{(B-A)/A\}\times 100 \qquad \text{(Formula 1)}$$

wherein A is the weight in gram of the fiber prior to water absorption; and B is the weight in gram of the fiber after water absorption and draining.

The term "water retentivity" means the value represented by the following formula 2;

$$W(\%)=\{(D-C)/C\}\times 100 \qquad \text{(Formula 2)}$$

wherein C is the weight in gram of the fiber prior to water absorption; and D is the weight in gram of the fiber after water absorption and draining and subsequent centrifuge for dehydration.

The fineness of the fiber F is 5 denier or more to 15 denier or less; and the dry strength thereof is 0.8 g/denier or more.

Because the fiber has such high absorbency and water retentivity as described above, even a small amount of the fiber can absorb much water. Therefore, an absorbent member prepared from the highly water-retentive fiber F as the raw material can be made slim. Because the fiber strength is high at some degree, the fiber can be readily handled at the manufacturing process of the absorbent member.

The viscose rayon-polyacrylate based fiber F of high water retentivity is at a state of filament. For manufacturing a sheet from the viscose rayon-polyacrylate based fiber F of high water retentivity, the filamentous fiber is cut into pieces of a length of 5 mm to 50 mm, which are used as short fiber. The short fiber is excellent in terms of absorbency and water retentivity, even if used singly. Preferably, nevertheless, the short fiber is mixed with a super absorbent plymers (SAP) such as polyacrylate salt and other absorbent members such as pulp. The content of each of the components in the mixture is preferably as follows; the content of the viscose rayon-polyacrylate based fiber F of high water retentivity is 10% by weight or more to 100% by weight or less; the content of SAP is 0% by weight or more to 50% by weight or less; and the content of pulp is 0% by weight or more to 50% by weight or less.

The fiber F or the mixture of the fiber F with SAP and pulp is packed in a paper sheet and the like as it is, for use as an absorbent member in disposable diaper and sanitary napkin. Both at dry state and at a water-absorbed state, then, the fiber F retains the shape as fiber. Therefore, the fiber hardly makes any sift in paper sheet. At a water-absorbed state, in particular, the polyacrylate salt swells in the fiber to fall into a gel state, but the motion is regulated between the cellulose fiber. The disposable diaper and sanitary napkin using this absorbent member never give any unpleasant feeling to the wearers.

Otherwise, this mixture can be used as a material to form a sheet; or knitted into other fiber webs or nonwoven fabric. The basis weights of the sheet, fiber webs or nonwoven fabric formed from the mixture is preferably 10 g/m$^2$ or more to 500 g/m$^2$ or less.

Figure 4:
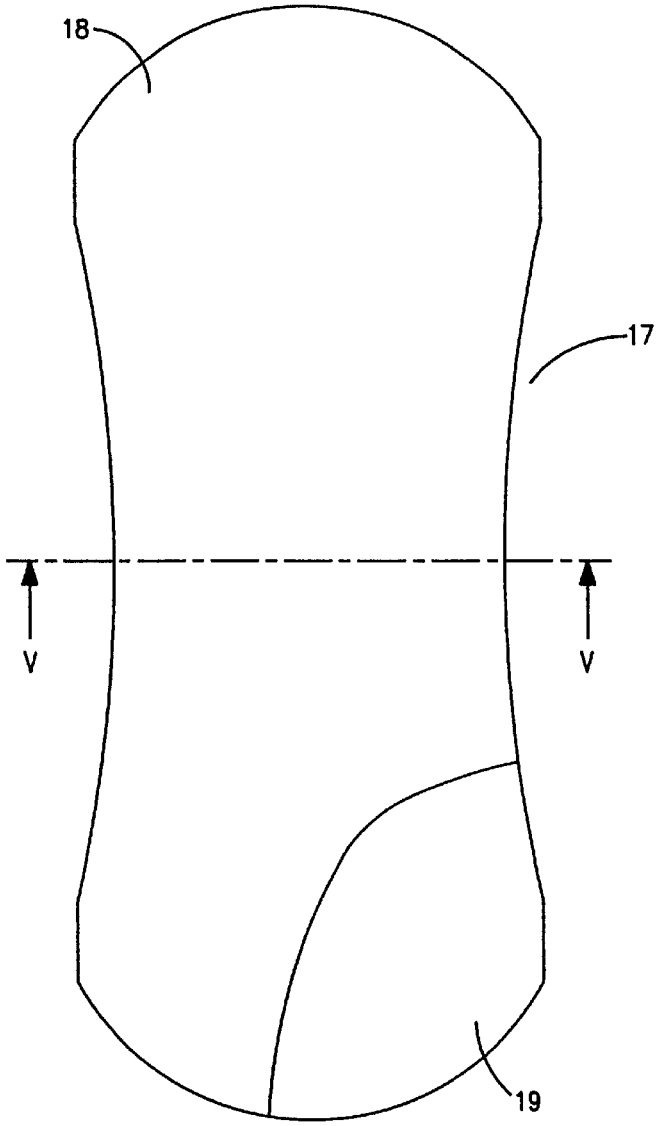
FIG. 4 is a view depicting the structure of an absorbent member in a sanitary napkin using the fiber of high water retentivity.
Figure 5:
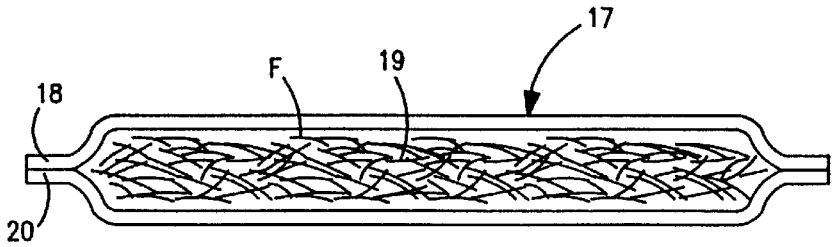
FIG. 5 is a cross sectional view of the absorbent member taken along the line V—V in FIG. 4.

Several pieces of the thus produced water retentive sheet containing the viscose rayon-polyacrylate based fiber F of high water retentivity are laminated together or are laminated with paper sheets from top and bottom, to bond together the individual sheets in lamination. The bonded sheets are then molded into a given shape as shown in FIG. 4, when the sheets are used as an absorbent member of for example sanitary napkin. Otherwise, each of the water-retentive sheets is molded into a shape as shown in FIG. 4, prior to being laminated to each other for adhesion. FIG. 5 is a cross sectional view along line V—V in FIG. 4. In the absorbent member 17 shown in FIGS. 4 and 5, the water-retentive sheet 19 containing the viscose rayon-polyacrylate based fiber F of high water retentivity is interposed between paper sheets 18 and 20. If the water-retentive sheet 19 contains SAP and pulp at greater amounts, the paper sheets 18 and 20 are preferably thus laminated on the bottom and top of the water-retentive sheet 19, to pack the water-retentive sheet 19 with the paper sheets 18 and 20 preventing SAP and pulp from coming off. If the water-retentive sheet 19 contains a greater amount of the viscose rayon-polyacrylate based fiber F of high water retentivity than those of SAP and pulp or if a water-retentive sheet is formed such that the viscose rayon-polyacrylate based fiber F of high water retentivity is knitted into other fiber webs or nonwoven fabric, on the other hand several pieces of the water-retentive sheet 19 alone are laminated together, with no packaging between paper sheets.

After the water-retentive sheet 19 and the paper sheets 18 and 20 are laminated together or after several pieces of the water-retentive sheet 19 are laminated together, the individual sheets are bonded together with an adhesive on the individual attached faces. The adhesion of the individual sheets may satisfactorily be conducted by coating an adhesive such as hot-melt adhesive on the attached faces of the individual sheets and subsequently pressing the sheets together under heating. So as to elevate the shape stability of the absorbent member 17, alternatively, a hot-melt fiber is satisfactorily mixed with the water-retentive sheet 19 and the paper sheets 18 and 20. A given shape of sheet can be formed by mixing the fiber F of high water retentivity with the hot-melt fiber, followed by thermal processing. Because the fiber F of high water retentivity in the sheet is securely bonded together through the hot-melt fiber, the sheet hardly loses its shape. After laminating together the sheets containing the hot-melt fiber, the hot-melt fiber melts under heating to fuse the hot-melt fiber together on the individual attached faces of the individual sheets. Thus the individual sheets adhere together. For mixing the hot-melt fiber into the water-retentive sheet 19, the viscose rayon-polyacrylate based fiber F of high water retentivity is mixed with the hot-melt fiber, and thereafter, fiber webs or nonwoven fabric is satisfactorily produced from the mixture. The viscose rayon-polyacrylate based fiber F of high water retentivity contained in the water-retentive sheet is preferably 10% by weight or more to 80% by weight or less, while the hot-melt fiber is 20% by weight or more to 80% by weight or less.

After adhesion, the resulting sheet is molded into a given shape as shown in FIG. 4, to form absorbent member 17.

The absorbent member 17 is interposed between a liquid pervious sheet to be adapted toward skin and a non-pervious sheet to be exposed outwardly, to prepare sanitary napkin.

For using the absorbent member in disposable diaper and pad, additionally, the absorbent member is satisfactorily molded so as to fit the shape of the disposable diaper and pad. The absorbent member is interposed between a liquid pervious top sheet to be adopted toward skin and a liquid non-pervious back sheet to be exposed outwardly.

The absorbent member 17 thus formed can get greater absorbency and water retentivity even if the absorbent member is of a slim type, owing to the higher absorbency and higher water retentivity of the viscose rayon-polyacrylate based fiber F of high water retentivity in the water-retentive sheet 19. Because the viscose rayon-polyacrylate based fiber F of high water retentivity in the water-retentive sheet 19 does not fall into a gel state, the shape of the absorbent member 17 is kept, as it is before water absorption.

EXAMPLES

By the same method as the method of manufacturing the viscose rayon-polyacrylate based fiber F of high water retentivity as described above, viscose rayon-polyacrylate based fibers of high water retentivity in Examples 1 to 22 as shown in Tables 1, 2 and 3 were produced, except for the modification of the manufacture conditions such as the modification of the compositions of the stock solutions A and B and the change of the liquid for alkaline treatment.

TABLE 1

| Example No. | 1 | 2 | 3 | 4 | 5 | 6 | 7 |
|---|---|---|---|---|---|---|---|
| Viscose compositions | | | | | | | |
| Cellulose (% by weight) | | 9 | 9 | 9 | 9 | 9 | 9 |
| NaCH (% by weight) | | 5.7 | 5.7 | 5.7 | 5.7 | 5.7 | 5.7 |
| Hottenroth number | | 10 | 10 | 10 | 10 | 10 | 10 |
| Compositions of PA dispersion solutions | | | | | | | |
| PA (% by weight) | 30 | 30 | 30 | 30 | 30 | 30 | 30 |
| NaOH (% by weitht) | 6 | 6 | 6 | 6 | 6 | 6 | 6 |
| Compositions of stock solutions A | | | | | | | |
| Ceilulose(% by weight) | 8 | 6 | 3 | 7 | 3 | 7 | 3 |
| PA (% by weight) | 0.8 | 3 | 6 | 1.6 | 6 | 1.6 | 6 |
| NaOH (% by weitht) | 6 | 6 | 6 | 6 | 6 | 6 | 6 |
| Compositions of stock solutions of viscose B | | | | | | | |
| Cellulose (% by weight) | — | — | — | 9 | 9 | 4.5 | 4.5 |
| NaOH (% by weight) | — | — | — | 5.7 | 5.7 | 5.7 | 5.7 |
| PA (% by weight/cellulose) | 10 | 50 | 200 | 10 | 50 | 10 | 50 |
| Nozzle | BC 1000H 0.1 mmφ | BC 1000H 0.1 mmφ | BC 1000H 0.1 mmφ | BC 7660H 0.1 mmφ | BC 7660H 0.1 mmφ | BC 7660H 0.1 mmφ | BC 7660H 0.1 mmφ |
| Mixing ratio (volume) of stock solutions A & B | — | — | — | 1:1 | 1:1 | 1:2 | 1:1 |
| Solutions for alkaline treatment (% by weight) | none | none | none | none | none | none | none |
| pH of solutions for alkaline treatment | — | — | — | — | — | — | — |

TABLE 2

| Example No. | 8 | 9 | 10 | 11 | 12 | 13 | 14 | 15 |
|---|---|---|---|---|---|---|---|---|
| Viscose compositions | | | | | | | | |
| Cellulose (% by weight) | 9 | 9 | 9 | 9 | 9 | 9 | 9 | 9 |
| NaOH (% by weight) | 5.7 | 5.7 | 5.7 | 5.7 | 5.7 | 5.7 | 5.7 | 5.7 |
| Hottenroth number | 10 | 10 | 10 | 10 | 10 | 10 | 10 | 10 |
| Compositions of PA dispersion solutions | | | | | | | | |
| PA (% by weight) | 30 | 30 | 30 | 30 | 30 | 30 | 30 | 30 |
| NaOH (% by weight) | 6 | 6 | 6 | 6 | 6 | 6 | 6 | 6 |
| Compositions of stock solutions A | | | | | | | | |
| Cellulose (% by weight) | 6 | 6 | 6 | 6 | 3 | 3 | 3 | 3 |
| PA (% by weight) | 3 | 3 | 3 | 3 | 6 | 6 | 6 | 6 |
| NaOH (% by weight) | 6 | 6 | 6 | 6 | 6 | 6 | 6 | 6 |
| Compositions of stock solutions of viscose B | | | | | | | | |
| Cellulose (% by weight) | — | — | — | — | 9 | 9 | 9 | 9 |
| NaOH (% by weight) | — | — | — | — | 5.7 | 5.7 | 5.7 | 5.7 |
| PA (% by weight/cellulose) | 50 | 50 | 50 | 50 | 50 | 50 | 50 | 50 |
| Nozzle | generally 1000H 0.1 mmφ | generally 1000H 0.1 mmφ | generally 1000H 0.1 mmφ | generally 1000H 0.1 mmφ | generally 7660H 0.1 mmφ | generally 7660H 0.1 mmφ | generally 7660H 0.1 mmφ | generally 7660H 0.1 mmφ |
| Mixing ratio (volume) of stock solutions A & B | — | — | — | — | 1:1 | 1:1 | 1:1 | 1:1 |
| Solutions for alkaline treatment (% by weight) | SC 1% | SC 4% | SC 10% | SC 15% | SC 1% | SC 4% | SC 10% | SC 15% |
| pH of solutions for alkaline treatment | 11.2 | 11.5 | 11.6 | 11.7 | 11.2 | 11.4 | 11.6 | 11.7 |

TABLE 3

| Example No. | 16 | 17 | 18 | 19 | 20 | 21 | 22 |
|---|---|---|---|---|---|---|---|
| Viscose compositions | | | | | | | |
| Cellulose (% by weight) | 9 | 9 | 9 | 9 | 9 | 9 | 9 |
| NaOH (% by weight) | 5.7 | 5.7 | 5.7 | 5.7 | 5.7 | 5.7 | 5.7 |
| Hottenroth number | 10 | 10 | 10 | 10 | 10 | 10 | 10 |
| Compositions of PA dispersion solutions | | | | | | | |
| PA (% by weight) | 30 | 30 | 30 | 30 | 30 | 30 | 30 |
| NaOH (% by weight) | 6 | 6 | 6 | 6 | 6 | 6 | 6 |
| Compositions of stock solutions A | | | | | | | |
| Cellulose (% by weight) | 3 | 3 | 3 | 3 | 3 | 3 | 3 |
| PA (% by weight) | 6 | 6 | 6 | 6 | 6 | 6 | 6 |
| NaOH (% by weight) | 6 | 6 | 6 | 6 | 6 | 6 | 6 |
| Compositions of stock solutions of viscose B | | | | | | | |
| Cellulose (% by weight) | 4.5 | 4.5 | 4.5 | 4.5 | 9 | 9 | 9 |
| NaOH (% by weight) | 5.7 | 5.7 | 5.7 | 5.7 | 5.7 | 5.7 | 5.7 |
| PA (% by weight/cellulose) | 50 | 50 | 50 | 50 | 50 | 50 | 50 |
| Nozzle | BC 7660H 0.1 mmφ | BC 7660H 0.1 mmφ | BC 7660H 0.1 mmφ | BC 7660H 0.1 mmφ | BC 7660H 0.1 mmφ | BC 7660H 0.1 mmφ | BC 7660H 0.1 mmφ |
| Mixing ratio (volume) of stock solutions A & B | 1:1 | 1:1 | 1:1 | 1:1 | 1:1 | 1:1 | 1:1 |
| Solutions for alkaline treatment (% by weight) | SC 1% | SC 4% | SC 10% | SC 15% | NaOH 4% | $NaHCO_3$ 4% | EA 4% |
| pH of solutions for alkaline treatment | 11.2 | 11.4 | 11.6 | 11.7 | 13.8 | 8.7 | 11.7 |

Methods of manufacturing the viscose rayon-polyacrylate based fibers of high water retentivity of Examples 1 to 7 as shown in Table 1, the fibers of Examples 8 to 15 as shown in Table 2 and the fibers of Examples 16 to 22 as shown in Table 3 are described below, together the manufacture conditions. In Tables 1, 2 and 3, the polyacrylate salt is described as PA. The number of openings of a nozzle is represented in H. Referring to liquids for alkaline treatment, SC is an aqueous sodium carbonate solution; EA is an aqueous ethanol amine solution.

For manufacturing the viscose rayon-polyacrylate based fiber of high water retentivity, the elongation rate is represented as the ratio of the running velocity from a regeneration bath (velocity when the fiber is drawn out from the regeneration bath) to the final running velocity (running velocity of yarn after elongation process), as represented by the formula 3;

$$\text{Elongation rate (\%)}=[(\text{final velocity}/\text{velocity from regeneration bath})-1]\times 100. \quad \text{(Formula 3)}$$

DESCRIPTION OF INDIVIDUAL EXAMPLES

The manufacture conditions and manufacture methods in the individual Examples in Tables 1, 2 and 3 are described below.

Example 1

The viscose rayon-polyacrylate based fiber of high water retentivity of Example 1 was manufactured at the following processes (1) to (4).

(1) Powdered polyacrylate salt with a particle size of 3 to 5 μm (Acogel A as trade name; manufactured by Mitsui Thytech, Co.) was dispersed in an aqueous 6% by weight sodium hydroxide solution to a final solid content of 30% by weight in the aqueous solution.

(2) The solution manufactured at the process (1) was mixed with viscose with 9% by weight of cellulose and 5.7% by weight of alkali and with a Hottenroth number of 10 for general viscose rayon, and the concentrations of the components in the whole mixture were adjusted with an aqueous sodium hydroxide solution. Thus, stock solution A containing 8% by weight of cellulose, 0.8% by weight of polyacrylate and 6% by weight of sodium hydroxide concentration was prepared. The polyacrylate salt contained at 10% by weight to the total weight of the cellulose in this stock solution.

(3) The stock solution A manufactured at the process (2) was discharged from the nozzle in FIG. 2 into a regeneration bath. As the aqueous solution in the regeneration bath, use was made of an aqueous solution at a temperature of 47° C., which was composed of 110 g sulfuric acid, 17 g zinc sulfate and 340 g sodium sulfate in mixture per one liter of water. Additionally, a general nozzle with an opening diameter of 0.1 mm and an opening number of 1000 was used, to discharge at a discharging velocity of 7.9 m/sec. The spinning bath immersion length then was 10 cm to 20 cm.

(4) The discharged stock solution at the process (3) turned yarn at a gel state in the regeneration bath. The yarn at a gel state was drawn out from the regeneration bath, by giving draft of 50% to 100% (1.5-fold to 2.0-fold), to elongate the yarn in the air at elongation process at an elongation rate of 40%, which was then passed through the refining process and subsequent drying process to prepare the fiber of high water retentivity of Example 1. The fiber is a fiber of a single component of polyacrylate salt uniformly mixed in rayon.

The fiber of Example 1 and the fibers of Examples 2 through 7 described below were produced with no alkaline treatment after refining process.

Examples 2 and 3

Only the composition of the stock solution A was modified as shown in Table 1, among the manufacture conditions in Example 1. The composition of the stock solution A in Example 2 was as follows; 6% by weight of cellulose, 3% by weight of polyacrylate salt and 6% by weight of sodium hydroxide. The stock solution A in Example 3 contained 3% by weight of cellulose, 6% by weight of polyacrylate salt and 6% by weight of sodium hydroxide. The concentration of the polyacrylate salt in the stock solution was 50% by weight to the cellulose weight in Example 2; and the concentration thereof was 200% by weight to the cellulose weight in Example 3. Using this stock solution A, viscose rayon-polyacrylate based fibers of high water retentivity were manufactured at the same manufacture process as in Example 1. The fibers of Examples 2 and 3 were fibers each comprising a single component of polyacrylate salt uniformly mixed into rayon as well.

Example 4

An aqueous sodium hydroxide solution of 6% by weight with the same powdered polyacrylate salt as used in Example 1 dispersed therein at 30% by weight was mixed with viscose containing 9% by weight of cellulose and 5.7% by weight of sodium hydroxide with a Hottenroth number of 10 for general viscose rayon. The resulting stock solution A contained 7% by weight of cellulose, 1.6% by weight of polyacrylate salt and a sodium hydroxide concentration of 6% by weight. The polyacrylate salt was contained in the stock solution A at 10% by weight to the total weight of cellulose.

Viscose at 9% by weight of cellulose and 5.7% by weight of alkali and with a Hottenroth number of 10 for general viscose rayon was defined as stock solution of viscose B.

Complex fibers were manufactured from these raw materials of the stock solutions A and the stock solution of viscose B. The nozzle was a nozzle for complex fiber of side by side type, having an opening diameter of 0.1 mm and an opening number of 7660; and the stock solution A and the stock solution of viscose B were fed at the same feeding ratio to be discharged into the same regeneration bath as used for manufacturing the fiber of high water retentivity of Example 1, at a discharging velocity of 6.1 m/sec.

Furthermore, the yarn at a gel state formed in the regeneration bath was drawn out from the regeneration bath by giving draft of 50% to 100%. The elongation process was conducted in the air to a final elongation rate of 40%, which was then passed through the refining process and subsequent drying process to prepare a complex fiber of side by side type. This complex fiber was defined as fiber of Example 4.

Example 5

Among the manufacture conditions of Example 4, the composition of the stock solution A was modified as follows; 3% by weight of cellulose, 6% by weight of polyacrylate salt and 6% by weight of sodium hydroxide. The polyacrylate salt in the stock solution A was contained at 50% by weight to the total weight of cellulose in the stock solution A. The stock solution of viscose B was the same as in Example 4. Other manufacture conditions were absolutely the same as in Example 4, and additionally, the same manufacture process as in Example 4 was used for manufacture. Consequently, a complex fiber of side by side type was manufactured.

Example 6

Stock solution A of the same composition as in Example 4 was used. As stock solution of viscose B, viscose with 9% by weight of cellulose and 5.7% by weight of sodium hydroxide and with a Hottenroth number of 10 for general viscose rayon was used, in which pure water and sodium hydroxide were added to final concentrations of cellulose and sodium hydroxide of 4.5% by weight and 5.7% by weight, respectively.

The stock solution A and the stock solution of viscose B were fed into a nozzle for complex fibers of side by side type, having an opening diameter of 0.1 mm and an opening number of 7660, to a final A/B ratio of ½. The manufacture process thereafter was totally the same as the fiber manufacture process in Example 4. Consequently, a complex fiber of sheath-core type was manufactured.

Example 7

As the stock solution of viscose B, use was made of a stock solution of viscose of the same composition as that of the stock solution of viscose B used in Example 6.

Additionally, stock solution A of the same composition as in Example 5 was used as the stock solution A. Using these stock solution A and stock solution of viscose B, a highly water-retentive fiber was manufactured at the same manufacture process as in Example 5.

Examples 8 to 15

The fibers of Examples 8 to 11 were manufactured at the fiber manufacture process as in Example 2, except that alkali treatment with immersion in aqueous sodium carbonate solutions with different concentrations of 1% by weight, 4% by weight, 10% by weight and 15% by weight, at 25° C. for 5 minutes, was done after refining process, prior to drying.

The fibers of Examples 12 to 15 were complex fibers of side by side type, which were manufactured at the fiber manufacture process of complex fibers of side by side type as in Example 5, except that alkali treatment with immersion in aqueous sodium carbonate solutions with different concentrations of 1% by weight, 4% by weight, 10% by weight and 15% by weight, at 25° C. for 5 minutes, was done after refining process, prior to drying process.

Examples 16 to 19

The fibers of Examples 16 to 19 were complex fibers of sheath-core type, which were manufactured at the fiber manufacture process of complex fibers of sheath-core type as in Example 7, except that alkali treatment with immersion in aqueous sodium carbonate solutions with different concentrations of 1% by weight, 4% by weight, 10% by weight and 15% by weight, at 25° C. for 5 minutes, was done after refining process, prior to drying process.

Examples 20 to 22

The fiber of Example 20 was manufactured at the fiber manufacture process of complex fibers of side by side type as in Example 5, except that alkali treatment with immersion in an aqueous sodium hydroxide solution of 4% by weight at 25° C. for 5 minutes was done after refining process, prior to drying process. The fiber of Example 21 was manufactured at the fiber manufacture process of complex fibers of side by side type as in Example 5, except that alkali treatment with immersion in aqueous sodium bicarbonate solution of 4% by weight at 25° C. for 5 minutes was done after refining process, prior to drying process. Like the fibers of Examples 20 and 21, the fiber of Example 22 was manufactured at the fiber manufacture process of complex fiber of side by side type as in Example 5, except that alkali treatment with immersion in an aqueous ethanol amine solution (EA) of 4% by weight at 25° C. for 5 minutes was done after refining process, prior to drying process.

(Test Results)

The shape (shape of cross section), absorbency, water retentivity, fineness and dry strength of each of the fibers of Examples 1 to 22 are shown in Table 4.

TABLE 4

| Example No. | 1 | 2 | 3 | 4 | 5 | 6 | 7 |
|---|---|---|---|---|---|---|---|
| Shape | M | M | M | S/S | S/S | S/C | S/C |
| Absorbency (%) | 708 | 730 | 792 | 1300 | 1350 | 1240 | 1270 |
| Water retentivity (%) | 203 | 225 | 240 | 401 | 425 | 472 | 480 |
| Fineness (de) | 4.78 | 4.56 | 4.74 | 4.97 | 4.87 | 4.85 | 4.91 |
| Dry strength (g/d) | 0.85 | 0.82 | 0.80 | 0.99 | 0.92 | 1.06 | 1.00 |

| Example No. | 8 | 9 | 10 | 11 | 12 | 13 | 14 | 15 |
|---|---|---|---|---|---|---|---|---|
| Shape | M | N | M | M | S/S | S/S | S/S | S/S |
| Absorbency (%) | 730 | 805 | 812 | 800 | 1380 | 1610 | 1620 | 1620 |
| Water retentivity (%) | 230 | 270 | 282 | 252 | 450 | 575 | 600 | 602 |
| Fineness (de) | 4.85 | 4.91 | 4.95 | 4.70 | 4.89 | 5.12 | 5.14 | 5.14 |
| Dry strength (g/d) | 0.84 | 0.81 | 0.80 | 0.74 | 0.90 | 0.98 | 0.92 | 0.87 |

| Example No. | 16 | 17 | 18 | 19 | 20 | 21 | 22tz,1/43 |
|---|---|---|---|---|---|---|---|
| Shape | S/C | S/C | S/C | S/C | S/S | S/S | S/S |
| Absorbency (%) | 1275 | 1287 | 1290 | 1290 | 1150 | 1100 | 1200 |
| Water retentivity (%) | 480 | 480 | 485 | 480 | 472 | 450 | 490 |
| Fineness (de) | 4.91 | 4.94 | 4.95 | 4.90 | 4.80 | 4.85 | 4.82 |
| Dry strength (g/d) | 0.99 | 0.91 | 0.90 | 0.90 | 0.80 | 0.92 | 0.89 |

In the column of shape, M represents routine fiber comprising a single component; S/S represents complex fiber of side by side type; and S/C represents complex fiber of sheath-core type.

The absorbency V in % was determined by the following method.

a. A sample is thoroughly split and left to stand in an atmosphere at a moisture of 65% for 24 hours, for adjustment of its moisture.

b. The sample (A gram) is weighed, which is then immersed in physiological saline for 3 minutes, and thereafter, water is drained off from the sample on a metal net for 5 minutes.

c. The weight of the sample after drainage is determined (B gram).

d. The absorbency is calculated by the following formula 1 on the basis of the aforementioned results.

$$V(\%)=\{(B-A)/A\}\times 100 \quad \text{(Formula 1)}$$

The water retentivity W in % was determined by the following method.

a. A sample is thoroughly split and left to stand in atmosphere at a moisture of 65% for 24 hours, for adjustment of its moisture.

b. The sample (C gram) is weighed, which is then immersed in physiological saline for 3 minutes, and thereafter, water is drained off from the sample on a metal net for 5 minutes.

c. The wet sample after drainage is centrifuged and dehydrated at 150 G (gravity) for 90 seconds, to weigh the resulting sample (D gram).

d. The water retentivity W in % is calculated by the following formula 2 on the basis of the aforementioned results.

$$W(\%)=\{(D-C)/C\}\times 100 \quad \text{(Formula 2)}$$

The fiber of the present invention is preferably at absorbency of 700% or more, water retentivity of 200% or more, fineness of 5 denier or more to 15 denier or less and dry strength of 0.8 gram/denier (g/d) or more.

The test results of the individual Examples are described.

Example 1

The fiber of Example 1 is a single component fiber, prepared from only the stock solution A. In the fiber, absorbency was 708%, water retentivity was 203%, fineness was 4.78 denier and dry strength was 0.85 g/d.

Under microscopic observation of the fiber, the particles of the polyacrylate salt were dispersed uniformly in the fiber.

The fiber retained the fiber shape at its state with water contained therein, with no fluidity, and the fiber had a strength such that the fiber could be drawn as mono-filament.

Examples 2 and 3

In the fiber of Example 2, absorbency was 730%, water retentivity was 225%, fineness was 4.56 denier and dry strength was 0.82 g/d.

In the fiber of Example 3, absorbency was 792%, water retentivity was 240%, fineness was 4.74 denier and dry strength was 0.85 g/d.

The concentration of the polyacrylate salt in the stock solution A was higher in the fiber of Example 3 than in the fiber of Example 2. Compared with the fiber of Example 2, the fiber of Example 3 had therefore higher absorbency and water retentivity.

Example 4

The fiber of Example 4 was a complex fiber of side by side type. In the fiber of Example 4, absorbency was 1300%, water retentivity was 401%, fineness was 4.97 denier and dry strength was 0.99 g/d. As has been described above, the fiber of Example 4 had far better absorbency and water retentivity than those of the fibers of the Examples 1, 2 and 3, along with the increased fineness and dry strength.

The microscopic observation of this fiber indicated that the fiber was a complex fiber, where a component comprising the particles of polyacrylate salt uniformly dispersed in the fiber and a component with no polyacrylate salt contained therein were attached together as side by side type.

The complex fiber retained the fiber shape when the fiber was at a state with water contained therein, with no fluidity. The fiber had a strength such that the fiber could be drawn as mono-filament.

Example 5

Like the fiber of Example 4, the fiber of Example 5 was a complex fiber of side by side type. And the absorbency was 1350%; the ratio of water absorbency was 425%; the fineness was 4.87 denier and the dry strength was 0.92 g/d. The fiber of Example 5 had both higher absorbency and water retentivity than those of the fiber of the Example 4, possibly because the concentration of the polyacrylate salt in the stock solution A was high.

This complex fiber retained the fiber shape when the fiber was at a state with water contained therein, with no fluidity. The fiber had a strength such that the fiber could be drawn as mono-filament.

Example 6

The results of microscopic observation indicated that the fiber of Example 6 was a complex fiber of sheath-core type, where the component of the stock solution A was contained in the core and the component of the stock solution of viscose B was contained in the sheath. The ratio of the polyacrylate salt to the total cellulose in the fiber was 10% by weight.

In the complex fiber, absorbency was 1240%, ratio of water retentivity was 472%, fineness was 4.85 denier and dry strength was 1.6 g/d.

It is possibly believed that the absorbency and water retentivity were lower than those of fibers of Examples 4 and 5, because the sheath part comprised the single cellulose component.

Example 7

The fiber was a complex fiber of sheath-core type, where the ratio of polyacrylate salt to the total cellulose in the fiber was 50% by weight. In the complex fiber, absorbency was 1270%, water retentivity was 480%, fineness was 4.91 denier and dry strength was 1.00 g/d.

Compared with the fiber of Example 6, the fiber of Example 7 had both higher absorbency and water retentivity, possibly due to the higher concentration of the polyacrylate salt in the stock solution A.

Examples 8 to 15

As apparently shown from the comparison with Example 2 and Example 5, the alkali treatment of fiber in an aqueous sodium carbonate solution prior to drying process enhances the absorbency and water retentivity. Furthermore, the treatment in an aqueous sodium carbonate solution of a higher concentration enhances the absorbency and water retentivity, compared with the treatment in an aqueous sodium carbonate solution of a lower concentration.

The complex fiber retained the fiber shape at a state with water contained therein, with no fluidity. At the state, then, the fiber had a strength such that the fiber could be drawn as mono-filament.

Examples 16 to 19

Absorbency and water retentivity were kept high like Examples 8 to 15, compared with Example 7 with no treatment in aqueous sodium carbonate solutions.

However, the fineness and drying strength were both low more or less.

Examples 20 to 22

The fibers of Examples 20 to 22 were manufactured by treating the fiber of Example 5 with different types of alkaline solutions. Compared with Example 5, the fibers had higher water retentivity but lower absorbency. Compared with Example 5, furthermore, the fineness and dry strength were not so much different.

However adhesion of fibers was observed in the fiber of Example 20 as treated with an aqueous sodium hydroxide solution. In the fiber of Example 22 as treated with an aqueous ethanol amine solution, residual odor was detected in the fiber after drying. Therefore, it is possibly believed that a liquid preferable for alkaline treatment is an aqueous sodium carbonate solution.

The test results described above indicated that the fibers of high water retentivity of Examples 1 to 22 had absorbency of 700% or more, water retentivity 200% ore more, fineness of 4.7 denier ore more and dry strength of about 1 g/d. The fibers can satisfy the requirements for the fiber of high water retentivity of the present invention.

INDUSTRIAL AVAILABILITY

The cellulose based fiber of high water retentivity of the present invention can keep its fiber shape even in a water-absorbed state, and therefore, the fiber can have more better shape retention potency at any state during drying and wetting, compared with the conventional water-retentive material consisting fluff pulp in combination with a powdered absorbent polymers. When polyacrylate salt is used as a highly water-retentive material in the fiber, the cellulose fiber can regulate the motion of the polyacrylate salt even if the polyacrylate salt swells and turns into a gel state. Accordingly, no unpleasant touch may be felt by a wearer when the fiber of high water retentivity is packed between paper sheets for use as an absorbent member for disposable diaper, sanitary napkin, pad and the like, and is applied to a wearer.

Furthermore, the fiber of high water retentivity of the present invention can singly compose a sheet for use as an absorbent member. Otherwise, by mixing the present fiber with known super absorbent polymers (SAP) and pulp fiber, a sheet can then be prepared from the resulting mixture. Therefore, an absorbent member with high absorbency and slimness, can be prepared, and can get further enhanced shape retention potency as such sheet.

In the fiber of high water retentivity of the present invention, absorbency is 700% or more. Additionally, water retentivity is 200% or more, capable of retaining water of 100 g or more per fiber of 50 g. Thus, the water-retentive sheet produced from the water-retentive fiber as a raw material can preferably be used as an absorbent member in disposable diaper, sanitary napkin, pad and the like.

Additionally, the fiber of high water retentivity is easily worked because the fiber strength is as high as about 1 g/d at its dry state.

Particularly because the polymer composing the fiber is not a synthetic polymer such as polyacrylonitrile but cellulose, the polymer is so rapidly degradable in soil that it has such a property that it can be readily disposed.

The system of manufacturing the fiber of the present invention is almost the same as the manufacture system of general viscose rayon. Thus, no specific equipment is needed to manufacture the fiber of the present invention. Hence, the fiber can be manufactured at low cost.

We claim:

1. A cellulose based fiber of high water retentivity wherein a core is formed from a component of a non-cellulose based material of high absorbency uniformly contained in cellulose based fiber and the core is enveloped with a sheath formed from said cellulose based fiber.

2. A cellulose based fiber of high water retentivity according to claim 1, wherein the cellulose based fiber is viscose rayon and the non-cellulose based material of high absorbency is polyacrylate salt.

3. A cellulose based fiber of high water retentivity according to claim 1, wherein a absorbency is 700% or more.

4. A cellulose based fiber of high water retentivity according to claim 1, wherein a water retentivity is 200% or more.

5. A cellulose based fiber of high water retentivity according to claim 1, wherein a dry strength of the fiber is 0.8 gram/denier or more.

6. A cellulose based fiber of high water retentivity according to claim 1, wherein a fineness of the fiber is 5 denier or more to 15 denier or less.

* * * * *